United States Patent [19]

Lechner

[11] 3,941,212

[45] Mar. 2, 1976

[54] CLOCKWORK MOTOR, ESPECIALLY FOR TOYS

[75] Inventor: Walter Lechner, Siegelsdorf, Germany

[73] Assignee: Messrs. STELCO Speilwarenfabrik Stelter GmbH & Co. KG, Germany

[22] Filed: Mar. 13, 1975

[21] Appl. No.: 558,014

[30] Foreign Application Priority Data

May 7, 1974 Germany ..... 2421967

[52] U.S. Cl. ..... 185/37; 58/80; 185/39; 188/83

[51] Int. Cl.[2] .. F03G 1/00; F16D 49/00; G04B 3/00

[58] Field of Search ..... 185/37, 39; 58/46 R, 63, 58/73, 80; 188/83

[56] References Cited

UNITED STATES PATENTS

| | | | |
|---|---|---|---|
| 328,830 | 10/1885 | Wickizer | 185/37 |
| 329,295 | 10/1885 | Elliott | 185/37 |
| 769,544 | 9/1904 | Hillgren | 185/37 |
| 3,052,421 | 9/1962 | Fischer | 188/83 X |
| 3,156,324 | 11/1964 | Colbert | 188/83 X |

*Primary Examiner*—Allan D. Hermann
*Attorney, Agent, or Firm*—Marn & Jangarathis

[57] ABSTRACT

The invention concerns a clockwork motor, particularly but not exclusively, for toys, wherein an escapement consisting of a friction memeber that is pressed resiliently against a sliding surface moving with a part of the clockwork motor running down under the action of a mainspring, and wherein the pressure force for the friction member is arranged to be approximately proportional at any given moment to the driving force of the mainspring at the moment. The friction member is mounted on a carrier spaced from and movable relative to the sliding surface, and a stationary end of the mainspring engages with the carrier.

8 Claims, 3 Drawing Figures

CLOCKWORK MOTOR, ESPECIALLY FOR TOYS

The invention concerns a clockwork motor with an escapement device that has a friction member resiliently pressed against a sliding surface which moves with the clockwork motor running down under the effect of a mainspring. The clockwork motor according to the invention is intended particularly, but not exclusively, for toys.

The use of an escapement device consisting of a friction member and a sliding surface in a clockwork motor permits the costs of the construction of the escapement relative to currently used constructions considerably to be reduced. However, this escapement device has the drawback that it is not always possible to achieve a uniform drive for the object equipped with a clockwork motor.

Accordingly, the invention seeks to provide a clockwork motor which runs down very uniformly and is suitable e.g. for driving a toy watch or the like, and wherein there is provided a particularly useful and reliable mechanism for ensuring that the instantaneous force pressing the friction member against the sliding surface is approximately proportional to the instantaneous driving force of a resilient member functioning as a mainspring. Thus so long as the member or mainspring is still highly tensioned, i.e. its driving force is large, it is desired that the friction member should be pressed against the sliding surface more strongly and thus the braking effect should be greater than when it is already nearly run down i.e. its driving force is weak.

According to the present invention, there is provided a clockwork motor, particularly for toys, comprising a resilient member adapted to function as a mainspring, an escapement consisting of a friction member mounted on a carrier spaced from and moved relative to a sliding surface, which in use moves with a part of the clockwork motor running down under the action of the resilient member, a stationary end of the resilient member that normally serves for support being in engagement with the carrier such that the friction member is pressed towards the sliding surface with a force that is approximately proportional at any given moment to the driving force of the resilient member at that moment.

It is preferred to keep the carrier of the friction member away from the sliding surface by spring means so as reliably to reduce the frictional force when the force of the resilient member is slackened. This can be very simply achieved by constituting the carrier for the friction member as a resiliently deformable hoop.

A particularly space-saving clockwork motor, suitable as the drive for a toy watch or the like is obtained where in a bore of a base plate one end of a drive shaft is journalled, at which one end of the resilient member, formed as a coil spring surrounding the drive shaft concentrically, engages, the other end thereof having a radially projecting arm supported at an abutment of a hoop-shaped, pivotable carrier arranged on the base plate and carrying a radially inwardly extending friction member that lies against a sliding surface arranged concentrically about the drive shaft.

In order further to reduce the already low number of parts of this clockwork motor one may so proceed that the sliding surface is the peripheral surface of a gear with which a gear wheel of a crown shaft engages.

Expediently, the hoop-shaped carrier lies against a stop near its pivot point for limiting its pivotal movement towards the sliding surface, whereby it is possible to limit the pressing force of the friction member even when in given cases the secured end of the mainspring presses strongly against the carrier.

Where the hoop-shaped carrier is of relatively stiff material, it may have a cut-out between the stop and the friction member on the inner side of the hoop to improve its flexibility. This embodiment is chosen e.g. where the carrier is stamped out in one piece from plastics.

Finally, it lies within the scope of the invention that the friction member is a section of a cord stretched between two supports on the carrier and made of an elastic material, e.g. an appropriate rubber. Through the appropriate choice of the material of the friction member according to the intended use the braking effect arising by the friction member and the sliding surface sliding over each other may naturally be adjusted appropriately.

Further characteristics, details and advantages of the invention will appear from the following description of a preferred embodiment with reference to the drawing.

The drawing shows:

Figure 2:
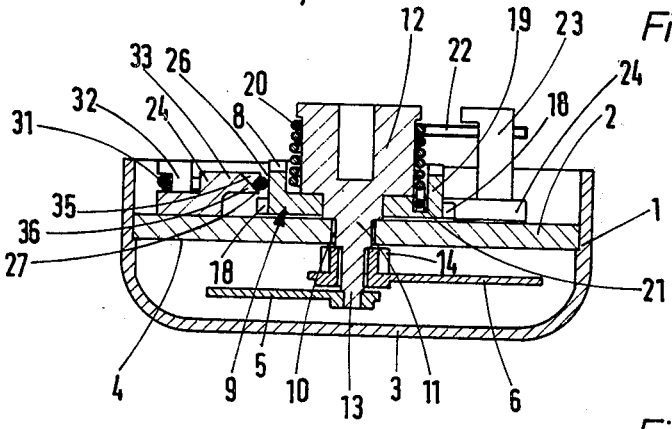
FIG. 2 is a section taken along line II — II.
Figure 3:
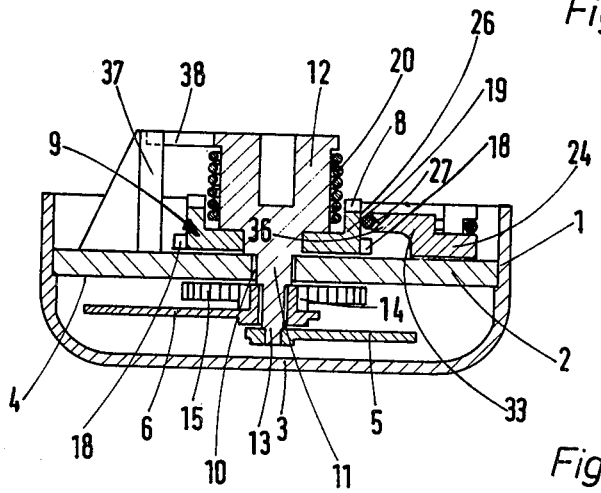
FIG. 3 is a section taken along line III — III of FIG. 1.

As can be seen from the drawing, in the illustrated example a base plate 2 mounted in a casing 1 serves as carrier for the whole clockwork motor. The back cover of the casing 1 that closes the clockwork motor has been removed, as seen in FIGS. 2 and 3; the front 3 of the casing is transparent and thus allows the undersurface (as seen in the drawing) of the base plate 2 serving as a dial 4, as well as the hands 5 and 6 of the toy watch, to be seen.

In the drawing the crown has been omitted; it is located by the non-illustrated cover, rests in a bearing 7 and engages with a toothed rim 8 at the rearward edge of an annular element 9, which latter will be described in greater detail below.

The base plate 2 has a central bore 10 that surrounds a reduced cross-section extension 11 of a stepped cylindrical body 12 serving as a drive shaft. The end 13 of the drive shaft 12 that projects downwardly through the base plate 2 carries the hour-hand 5 directly. At the same time this end 13 serves as a bearing for the minute-hand 6 freely rotatably journalled on the end 13 and connected with a gear wheel 14. The gear wheel 14 for driving the minute-hand 6 meshes with an intermediate gear wheel 15 which is provided on the underside of the base plate 2 and which is connected via an axis 16 with a further gear wheel 18 on the upper or rear side of the base plate 2. The gear wheel 17 engages with an outer gear rim 18 of the part 9 and thus on rotation of the latter the wheel 17 is also rotated. Since the part 9 rotates with the drive shaft 12, it is thereby achieved that the minute-hand 6 rotates faster than the hour-hand 5 corresponding to the commercial standard; self-evidently the usual transmission ratio of 1:12 can be adjusted by appropriate selection of the number of teeth of the gears 14, 15, 17 and 18.

As already mentioned, the ring-like part 9 has tooth rims, viz. the front rim 8 that is used for winding up the clockwork motor, and the radial tooth rim 18 that drives the minute-hand 6 via the gears 17, 15 and 14. The ring-shaped part 9 is so connected with the drive shaft 12 or the drive shaft body that the parts 9, 12 always rotate together.

In the space between the drive shaft body 12 and the cylindrical periphery 19 of the part 9 a portion of a helical coil spring 20 is arranged, the coil spring serving as the drive spring (mainspring) for the illustrated clockwork motor. One end 21 (FIG. 2) of the mainspring 20 is so connected with the part 9 that the latter, and consequently the drive shaft body 12 also turn together as releasing the spring (20) unwinds.

Figure 1:
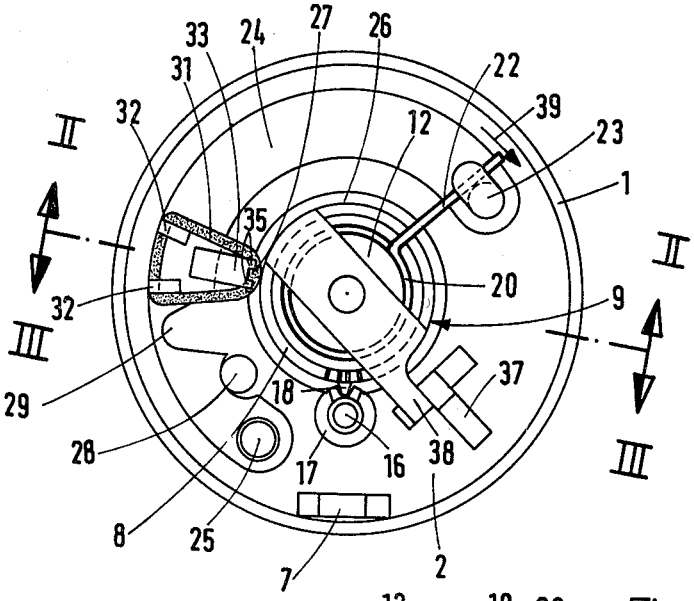
FIG. 1 is a plan view of a clockwork motor as the drive of a toy watch from the side opposite to the dial.

The other, fixed end 22 of the spring 20 is outwardly bent to a radially projecting arm, in the illustrated example. This arm 22 lies (FIGS. 1, 2) against an abutment 23 of a hoop-shaped carrier 24. The carrier 24 is pivotally journalled on the base plate 2 by way of a bearing 25 (FIG. 1). Its pivotal movement towards the ring-shaped part or its cylindrical section 19, the outer surface 26 of which constitutes a sliding surface for the friction member 27, is limited by an abutment 28 of the base plate 2. In the illustrated exemplary embodiment the carrier 24 consists of somewhat springy bendable plastics so that it opposes by a certain resistance any bending towards the ring body 9. The flexibility of the carrier 24 in its own plane, i.e. parallel with the base plate 2, is increased in the embodiment illustrated in the drawing by the carrier having a cut-out portion 29 between the pivot bearing 25 and the friction member 27.

Further, it may clearly be seen from the drawing that in the present case the friction member 27 is a section of cord 31 of elastic material stretched on the carrier 24. Hook-like extensions 32 serve to locate the cord 31, e.g. a ring, on the upper side of the carrier and locate the section 31 on the side of the carrier remote from the sliding surface 26. As the cord 31 must project over the carrier 24 towards the sliding surface 26 to form the friction member 27, on this side its location ensues with the aid of a support element 33 which at its peak at the top has two triangular-section, projecting noses 35, while between these two mutually spaced noses 35 there is only one central nose 36 on the underside, which noses hold the cord 31 so that it projects somewhat, in order to form the friction member 27.

Finally, another extension 37 is formed on the base plate 2 which cooperates with an extension 38 on the drive shaft 12 to limit the movement of the clockwork motor in running down and winding up.

The mode of operation of the clockwork motor according to the invention is as follows:

Assuming that the case (at the top in FIGS. 2 and 3) is put on and thereby the non-illustrated crown shaft is so located in the journal block 7 that a gear wheel of the crown shaft engages the front gear rim 8 of the ring-shaped part 9, by rotation of the crown shaft the ring part 9 can be turned and thus the end 21 of the mainspring 20 connected to this part 9 can be moved while tensioning the spring. Preferably the crown shaft is so arranged that after termination of the winding-up clockwork motor does not immediately begin to run, but only when the crown shaft is brought to a certain position, e.g. pulled radially outwardly, whereby the gear wheel of the crown shaft no longer meshes with the gear rim 8.

By tensioning the mainspring 20, the arm 22 serving to support the spring 20 is also moved in the direction of the arrow 39, which results in a corresponding movement of the carrier 24 for the friction member 27. Thus the pressure of the friction member 27 against the sliding surface 26 of the ring 9, and consequently the braking effect between the sliding surface 26 and the friction member 27, is increased.

If the clockwork motor is allowed freely to run down, the drive shaft 12 is rotated by the unwinding spring 20, whereby a corresponding rotation of the hands 5 and 6 results. In given cases, the rotation of the gear wheel 15, which can be seen in the illustrated exemplary embodiment, may be used for effecting another indication function, e.g. for reproducing a second-hand.

When the spring 20 has unwound, the force exerted on the end 22 in the direction of the arrow 39 is gradually reduced, whereby also the pressure of the friction member 27 against the sliding surface 26 is reduced. As a consequence of this the weakening driving force of the spring 20 also reduces the braking force. Thereby there is obtained, as has already been mentioned several times, a highly uniform run-down of the clockwork motor which in the present case is particularly suitable for simulating the movement processes that take place in a watch. It should be noted, however, that in a toy watch that need not show the time accurately, it is expedient to run the movement down at a considerably accelerated rate so that the playing child receives an actual impression of real hand movement which of course normally in a watch cannot be followed. As soon as both extensions 37, 38 once again come to lie against each other, the run-down movement of the clockwork motor terminates and must be wound up again in the usual manner.

In the illustrated embodiment a sliding coupling, e.g. by suitable fitting, is provided between the ring 9 and the drive shaft portion 12. The use of such a sliding coupling affords the possibility of adjusting the hands, particularly the hand 6, by means of the crown shaft independently of the actual position of winding of the spring 20.

Naturally the invention is not restricted to the illustrated embodiment. Thus the clockwork motor according to the invention may be used for other fields of application where a greatest possible uniformity in running is important. Furthermore, the basic concept of the invention can be realised not only with a helical mainspring but also e.g. with a spiral mainspring or with an axially acting mainspring.

I claim as my invention:

1. Clockwork motor, particularly for toys, comprising a resilient member adapted to function as a mainspring, an escapement consisting of a friction member and a sliding surface, a carrier carrying the friction member and spaced from and movable relative to the sliding surface which in use moves with a part of the clockwork motor running down under the action of the resilient member, a stationary end of the resilient member that normally serves for support being in engagement with the carrier such that the friction member is pressed towards the sliding surface with a force that is approximately proportional at any given moment to the driving force of the resilient member at that moment.

2. Clockwork motor according to claim 1 in which means are provided for resiliently holding the friction member away from the sliding surface.

3. Clockwork motor according to claim 1 in which the carrier for the friction member is resilient, elastic, bendable hoop member.

4. Clockwork motor according to claim 1 further including a base plate, a drive shaft, a bore defined in the base plate, one end of a drive shaft being journalled in the bore, one end of the mainspring formed as a coil spring surrounding the said one end of the drive shaft concentrically; a hoop-shaped, pivotable carrier arranged on the base plate; an abutment of the carrier; a radially projecting arm at the other end of the mainspring being adapted to cooperate with said abutment; the carrier carrying the friction member which extends radially inwardly for engaging against the sliding surface arranged concentrically about the drive shaft.

5. Clockwork motor according to claim 4 in which the sliding surface is the peripheral surface of a gear adapted to mesh with a gear wheel of a crown shaft.

6. Clockwork motor according to claim 4 in which a stop is provided adjacent the pivot of the carrier for the latter to lie against so as to limit its pivotal movement towards the sliding surface.

7. Clockwork motor according to claim 6 in which the hoop shaped carrier has a cut-out for improving its flexibility between the stop and the friction member.

8. Clockwork motor according to claim 1 in which supports are provided on the carrier, and the friction member is constituted by a section of cord of elastic material stretched between the said supports.

* * * * *